US008168117B2

(12) United States Patent
Hansen

(10) Patent No.: US 8,168,117 B2
(45) Date of Patent: May 1, 2012

(54) METHOD TO IMPROVE STABILITY OF BURN-RESISTANT TITANIUM ALLOY

(75) Inventor: James O. Hansen, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 1159 days.

(21) Appl. No.: 11/595,141

(22) Filed: Nov. 9, 2006

(65) Prior Publication Data

US 2008/0112836 A1 May 15, 2008

(51) Int. Cl.

| | |
|---|---|
| ***C22C 1/05*** | (2006.01) |
| ***C22C 32/00*** | (2006.01) |
| ***C22C 33/02*** | (2006.01) |
| ***B22F 3/02*** | (2006.01) |

(52) U.S. Cl. ..... 419/14; 419/10; 419/11; 419/66

(58) Field of Classification Search ..... 75/228, 75/245, 746, 751, 765, 770, 950; 148/513, 148/421; 419/26, 28, 48–51, 66–69; 420/417, 420/421

See application file for complete search history.

(56) References Cited

U.S. PATENT DOCUMENTS

| | | | | |
|---|---|---|---|---|
| 5,068,003 | A * | 11/1991 | Takahashi et al. | 148/421 |
| 5,176,762 | A * | 1/1993 | Berczik | 148/407 |
| 2002/0108682 | A1 * | 8/2002 | Li et al. | 148/407 |

OTHER PUBLICATIONS

Callister, Jr., Materials Science & Engineering, An Introduction, Sixth edition, pp. 300-302, 370-376 (2003).*

Eylon, D. et al., "Titanium Powder Metallurgy Alloys and Composites," vol. 7, ASM Handbooks Online, 2002. (29 pages total).*

Tjong, S.C. and Z.Y. Ma, "Microstructural and mechanical characteristics of in situ metal matrix composites," Materials Science and Engineering, 29, pp. 49-113 (2002).*

* cited by examiner

*Primary Examiner* — Scott Kastler
*Assistant Examiner* — Vanessa Luk
(74) *Attorney, Agent, or Firm* — Carlson Gaskey & Olds, P.C.

(57) ABSTRACT

A powder metallurgy method includes the steps of forming a member, such as a work piece or an aerospace component, from a titanium alloy powder. The average size of a carbide phase in the titanium alloy powder is controlled in order to control an average size of a carbide phase in the member. In one example, an amount of carbon within the titanium alloy and size of the carbide phase are selected to provide a desirable balance of good hot workability, resisting formation of an alpha-titanium phase within the member and a desired level of fatigue performance.

20 Claims, 1 Drawing Sheet

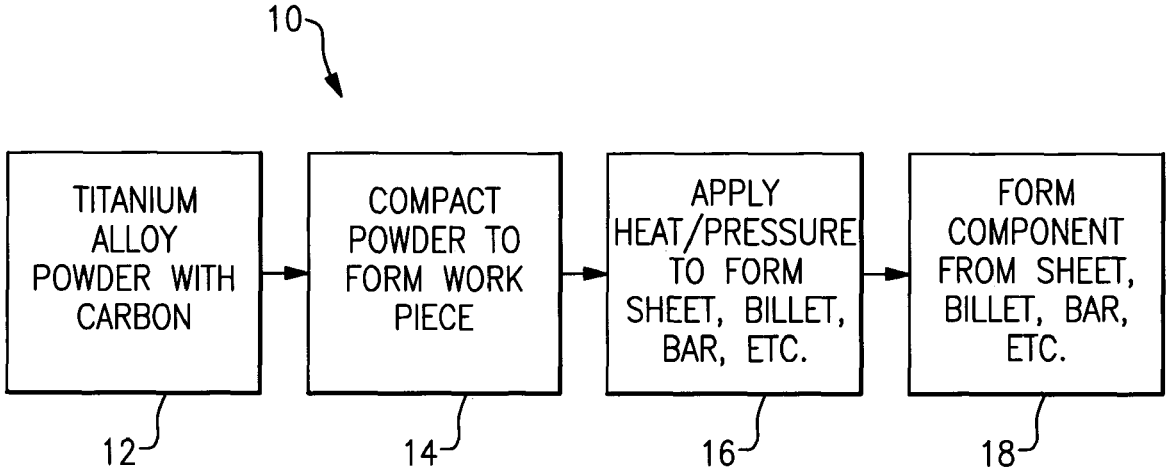
10
TITANIUM ALLOY POWDER WITH CARBON
COMPACT POWDER TO FORM WORK PIECE
APPLY HEAT/PRESSURE TO FORM SHEET, BILLET, BAR, ETC.
FORM COMPONENT FROM SHEET, BILLET, BAR, ETC.
12
14
16
18

METHOD TO IMPROVE STABILITY OF BURN-RESISTANT TITANIUM ALLOY

BACKGROUND OF THE INVENTION

This invention relates to powder metallurgy and, more particularly, to a powder metallurgy method for enhanced high temperature stability and hot workability of a burn-resistant titanium alloy.

Titanium alloys are known and used for manufacturing a variety of different aerospace components. Typically, the titanium alloy is cast into an ingot that is then formed into a billet, sheet, bar, or the like that is then formed into a component. At elevated temperatures, the titanium alloy typically forms alpha-titanium phase precipitates that embrittle the component and thereby undesirably limit a maximum use temperature of the component. Additionally, known titanium alloys are susceptible to cracking during hot working processes used to form mill products and components. Cracking limits conversion methods and reduces raw material yields, thereby increasing the expense of making the components.

One proposed solution to the problem of embrittlement and cracking during hot working is to add carbon to the titanium alloy to suppress formation of the alpha-titanium phase precipitates and improve the hot workability of the alloy. Presently, one drawback preventing widespread use of adding carbon is that the cast ingot processing method results in formation of large carbide phases that ultimately reduce fatigue performance of the component to undesirable levels. Adding less carbon to avoid the large carbide phases significantly reduces the effectiveness of the carbon for suppressing the alpha-titanium phase precipitates and improving the hot workability of the alloy. Thus, there has yet to be found a suitable combination of processing and composition for achieving a desirable combination of properties.

Accordingly, there is a need for a method of forming a component from a titanium alloy that includes carbon such that the component has a desired level of alpha-titanium phase suppression, fatigue performance, and resistance to cracking during hot working. This invention addresses those needs while avoiding the shortcomings and drawbacks of the prior art.

SUMMARY OF THE INVENTION

One example powder metallurgy method includes the steps of forming a member, such as a workpiece or an aerospace component, from a titanium alloy powder. An average size of a carbide phase within the titanium alloy powder is controlled in order to control an average size of a carbide phase in the member. The titanium alloy powder includes an amount of carbon that is suitable for resisting or suppressing formation of an alpha-titanium phase within the member at elevated temperatures and strengthening the member to resist cracking during hot working. The average size of the carbide phase in the member is also suitable for establishing a desired level of fatigue performance.

In one example, the titanium alloy powder is a burn-resistant composition having about 35% vanadium by weight, about 15% chromium by weight, more than 0.05% and less than about 1.2% carbon by weight, and a balance of titanium. In one example, the average size of the carbide phase is about 1 micrometer. The combination of the amount of carbon with powder metallurgy processing provides stability and strength of the member.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

FIG. 1 illustrates selected steps of an example method for enhancing stability, strength, and hot workability of a member made from a titanium alloy.

DETAILED DESCRIPTION OF THE PREFERRED EMBODIMENT

FIG. 1 illustrates an example method 10 for controlling an average size of a carbide phase in a titanium alloy powder to control an average size of a carbide phase in a formed member, such as a work piece (e.g., an in-process component) or an aerospace component. As will be described, the method 10 provides a combination of processing and titanium alloy powder composition for achieving a desired combination of properties in the work piece or final component, such as a desirable combination of stability at elevated temperatures, durability during hot working, and fatigue performance.

In the illustrated example, the method 10 generally includes a powder metallurgy step 12, wherein a selected amount of carbon is alloyed into the titanium alloy and then formed into the titanium alloy powder. In one example, the powder is formed in a known manner by rapidly cooling droplets of liquid titanium alloy such that the average size of the carbide phase of the titanium alloy powder is within a desired range. For example, the average size depends on the amount of carbon in the titanium alloy and a cooling rate of the liquid titanium alloy. Given this description, one of ordinary skill in the art will recognize suitable amounts of carbon and suitable cooling rates to meet their particular needs.

At a step 14, the titanium alloy powder is compacted into a desired shape to form a first work piece. In one example, a known method is used to compact the titanium alloy power to nearly 100% density. At a step 16, heat and pressure are applied to the first work piece to form a second work piece, such as a sheet, billet, bar, etc. At step 18, the second work piece is formed in a known manner into a final or near final component, such as an aerospace component.

The powder metallurgy processing of the method 10 in combination with using of an amount of carbon within a prescribed range provides the benefit of enhanced fatigue performance (due to a relatively small average size of carbide phase), high temperature stability, and improved hot workability due to the amount of carbon, as will now be described below.

In illustrated example method 10, the titanium alloy powder is a burn-resistant composition of titanium alloy. Titanium metal is known to be susceptible to rapid oxidation at certain conditions of elevated temperature and pressure. However, with the addition of an element or elements, the titanium alloy becomes resistant to rapid oxidation and self-sustained combustion. In one example, the burn-resistant titanium alloy composition includes vanadium, chromium, and titanium.

In one example, the titanium alloy powder with burn-resistant composition includes a composition having about 35% vanadium by weight, about 15% chromium by weight, more than 0.05% and less than about 1.2% carbon by weight (prescribed range), and a balance of titanium. In one example, the amount of carbon within the titanium alloy powder is between about 0.25% and 0.35% carbon by weight. In a further example, the amount of carbon is about 0.3% by weight of carbon. In one example, the titanium alloy powder essentially includes only the above elements in the prescribed percentages and, perhaps, trace amounts of other elements or substances. It is to be understood that even trace amounts of certain elements or substances may influence the effects described herein. In other examples, additional elements or substances may be desired with the above compositions to impart other desirable properties. The term "about" as used in this description relative to percentages or compositions refers to possible variation in the compositional percentages, such as normally accepted variations or tolerances in the art.

The average size of the carbide phase of the titanium alloy powder is selected such that the average size of the carbide phase in the second work piece or final component is less than a predetermined threshold size. In one example, the average size in the second work piece or final component is about equal to the average size in the titanium alloy powder. In another example, the heat and pressure of step 16 and/or the forming process of step 18 influences the average size of the second work piece or final component. The influence can be determined through conventional metallurgical techniques. Thus, by controlling the average size of the carbide phase in the titanium powder alloy one controls the average size of the carbide phase in the second work piece or final component to thereby establish a desired fatigue performance.

Generally, relatively smaller average sizes of the carbide phase are selected to increase fatigue performance. In one example, the average size of the carbide phase in the work piece or final component is below about 1 micrometer, which was heretofore unavailable through conventional ingot processing. The average size of the carbide phase can be determined in a known manner, such as by using known microscopy techniques.

Likewise, amounts of carbon within the prescribed range enhance hot workability and establish a continuous maximum use rating of the final component (i.e., durability). For example, the carbon acts to strengthen the titanium alloy during hot working. Amounts of carbon within the prescribed range are suitable for resisting, or in some examples perhaps even preventing, cracking during hot working. For example, the titanium alloy with an amount of carbon within the prescribed range resists cracking at step 16 (e.g., during extrusion, forging, or rolling) to enhance manufacturing yield that might otherwise be lost to cracking. In some examples, the resistance to cracking may even permit the method 10 to be used to make somewhat more complex components.

The addition carbon also resists or suppresses formation of an alpha-titanium phase, which is known to embrittle beta-titanium, at temperatures above 900° F. For example, the amount of carbon corresponds to a rate of formation of the alpha-titanium phase within the beta-titanium matrix at a predetermined temperature. Thus, by controlling the amount of carbon, one is thereby able to influence the rate of formation of the alpha-titanium phase. In one example, the formation of the alpha-titanium phase corresponds to a continuous maximum use temperature of the final component. Using an amount of carbon within the prescribed range corresponds to a continuous maximum use temperature of 900° F. for at least 350 hours. In another example, using an amount of carbon within the prescribed range corresponds to a continuous maximum use temperature of 1000° F. for at least 125 hours. In another example, using an amount of carbon within the prescribed range corresponds to a continuous maximum use temperature of 850° F. for an unlimited amount of time. The continuous maximum use temperatures described above can be determined using design specific parameters, standard testing procedures, or other evaluation techniques.

Thus, the disclosed example method 10 provides a suitable combination of processing and composition for achieving a desirable level of fatigue performance, strength, and durability. Selecting a particular amount of carbon within the prescribed range and a particular average size of carbide phase permits one to balance fatigue performance and durability/strength. Using amounts of carbon below 0.05% by weight provides a relatively small stabilizing effect at temperatures above 900° F. but results in relatively small average sizes of the carbide phase to increase the fatigue performance. Using amounts of carbon close to about 1.2% by weight provides relatively larger stabilizing effect at temperatures above 900° F. but results in somewhat larger average sizes of the carbide phase that reduce the fatigue performance. In one example, using an amount of carbon between about 0.25% and 0.35% carbon by weight provides a desirable balance of stabilizing effect and average size of carbide phase. In a further example, using about 0.3% by weight of carbon provides an even more desirable balance of stabilizing effect and average size of carbide phase. However, given this description, one of ordinary skill in the art will recognize suitable compositions within the prescribed range that meet their particular needs.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A powder metallurgy method comprising:

(a) forming a member from a titanium alloy powder; and (b) controlling an average size of a carbide phase in the titanium alloy powder to establish a desired average size of a carbide phase in the member.

2. The powder metallurgy method as recited in claim 1, wherein said step (a) includes forming the member from a burn-resistant composition of the titanium alloy powder.

3. The powder metallurgy method as recited in claim 1, wherein the titanium alloy powder includes vanadium, chromium, carbon, and titanium.

4. The powder metallurgy method as recited in claim 1, wherein the titanium alloy powder includes about 35% vanadium by weight, about 15% chromium by weight, more than 0.05% and less than about 1.2% carbon by weight, and a balance titanium.

5. The powder metallurgy method as recited in claim 1, wherein the titanium alloy powder includes about 35% vanadium by weight, about 15% chromium by weight, between about 0.25% and about 0.35% carbon by weight, and a balance titanium.

6. The powder metallurgy method as recited in claim 1, wherein the titanium alloy powder consists essentially of about 35% vanadium by weight, about 15% chromium by weight, about 0.3% carbon by weight, and a balance titanium.

7. The powder metallurgy method .as recited in claim 1, wherein said step (a) includes compacting the titanium alloy powder.

8. The powder metallurgy method as recited in claim 7, wherein said step (a) includes heating the titanium alloy powder and applying pressure to the titanium alloy powder.

9. The powder metallurgy method as recited in claim 8, further including selecting an amount of carbon within the titanium alloy powder that is greater than 0.05% by weight and less than about 1.2% by weight to resist cracking from the heating and pressure.

10. The powder metallurgy method as recited in claim 8, further including selecting an amount of carbon within the titanium alloy powder that is about 0.3% by weight to resist cracking from the heating and pressure.

11. The powder metallurgy method as recited in claim 8, wherein said step (a) includes a process selected from one of extruding, forging, and rolling.

12. The powder metallurgy method as recited in claim 1, wherein said step (b) includes controlling the average size of the carbide phase in the titanium alloy powder such that the desired average size of the carbide phase in the member is less than a predetermined threshold size.

13. The powder metallurgy method as recited in claim 1, wherein said step (b) includes controlling the average size of the carbide phase in the titanium alloy powder such that the desired average size of the carbide phase in the member is less than about 1 micrometer.

14. The powder metallurgy method as recited in claim 1, further including selecting an amount of carbon within the titanium alloy powder that is greater than 0.05% by weight and less than about 1.2% by weight to resist formation of an alpha-titanium phase within a beta-titanium matrix at a temperature above 900° F.

15. The powder metallurgy method as recited in claim 1, wherein said step (b) includes controlling cooling of liquid droplets of the titanium alloy to establish the average size of the carbide phase to be within the desired range.

16. A powder metallurgy method comprising:

(a) forming a first member from a titanium alloy powder having 35% vanadium by weight, about 15% chromium by weight, more than 0.05% and less than about 1.2% carbon by weight, and a balance of titanium, wherein at least a portion of the carbon is within a carbide phase;

(b) heating the first member and applying pressure to the first member to form a second member; and (c) controlling an average size of the carbide phase in the titanium alloy powder to establish a desired level of resistance to cracking during said step (b).

17. The powder metallurgy method as recited in claim 16, wherein said step (c) includes controlling the average size of the carbide phase in the titanium alloy powder such that the average size of the carbide phase in the second member is less than about 1 micrometer.

18. A powder metallurgy method comprising:

(a) forming a first member from a titanium alloy powder having 35% vanadium by weight, about 15% chromium by weight, more than 0.05% and less than about 1.2% carbon by weight, and a balance of titanium;

(b) heating the first member and applying pressure to the first member to form a second member;

(c) controlling an average size of a carbide phase in the titanium alloy powder to establish a desired level of resistance to cracking during said step (b);

(d) forming a third member from the second member; and (e) selecting an amount of the carbon to establish a desired rate of formation of an alpha-titanium phase within a beta-titanium matrix of the third member above a predetermined temperature.

19. The powder metallurgy method as recited in claim 18, wherein the desired rate of formation of the alpha-titanium phase corresponds to a continuous maximum use temperature of 900° F. for at least 350 h.

20. The powder metallurgy method as recited in claim 18. wherein said step (c) includes controlling cooling of liquid droplets of the titanium alloy to establish the average size of the carbide phase to be within a desired range.

* * * * *